US008083511B2

(12) United States Patent
Hasselberg et al.

(10) Patent No.: US 8,083,511 B2
(45) Date of Patent: Dec. 27, 2011

(54) SYSTEMS AND METHODS INVOLVING PATTERN MOLDS

(75) Inventors: Timothy P. Hasselberg, Middletown, CT (US); Carl R. Verner, Windsor, CT (US); Steven J. Bullied, Pomfret Center, CT (US); Mark F. Bartholomew, Enfield, CT (US)

(73) Assignee: United Technologies Corp., Hartford, CT (US)

( * ) Notice: Subject to any disclaimer, the term of this patent is extended or adjusted under 35 U.S.C. 154(b) by 33 days.

(21) Appl. No.: 11/950,726

(22) Filed: Dec. 5, 2007

(65) Prior Publication Data

US 2009/0146341 A1 Jun. 11, 2009

(51) Int. Cl.

| | |
|---|---|
| ***B29C 33/00*** | (2006.01) |
| ***B28B 17/00*** | (2006.01) |
| ***B22C 9/00*** | (2006.01) |
| ***B22C 7/00*** | (2006.01) |

(52) U.S. Cl. ..... 425/150; 425/453; 425/454; 425/576; 425/589; 164/35; 164/45; 264/219

(58) Field of Classification Search ..... 425/150, 425/453, 454, 576, 589; 164/35, 45; 264/219–227
See application file for complete search history.

(56) References Cited

U.S. PATENT DOCUMENTS

| | | | | |
|---|---|---|---|---|
| 5,069,613 | A * | 12/1991 | Inaba et al. | 425/150 |
| 5,744,173 | A * | 4/1998 | Sterett | 425/144 |
| 5,773,039 | A | 6/1998 | Jones | |
| 6,467,531 | B1 | 10/2002 | Doney | |
| 6,637,500 | B2 | 10/2003 | Shah et al. | |
| 6,892,789 | B2 | 5/2005 | Boyle | |
| 6,901,661 | B2 | 6/2005 | Jonsson et al. | |
| 6,929,054 | B2 | 8/2005 | Beals et al. | |
| 6,986,653 | B2 * | 1/2006 | Unterlander et al. | 425/150 |
| 7,108,044 | B2 | 9/2006 | Miyamoto et al. | |
| 7,108,045 | B2 | 9/2006 | Wiedemer et al. | |
| 7,270,173 | B2 | 9/2007 | Wiedemer et al. | |
| 2002/0174968 | A1 * | 11/2002 | Mertins | 164/45 |
| 2003/0075300 | A1 | 4/2003 | Shah et al. | |
| 2003/0094732 | A1 * | 5/2003 | Payette et al. | 264/255 |
| 2003/0098136 | A1 | 5/2003 | Ludwig et al. | |
| 2008/0302500 | A1 * | 12/2008 | Winkler | 164/45 |

OTHER PUBLICATIONS

Rosato, Dominick V.; Rosato, Donald V.; Rosaro, Marlene G. Injection Molding Handbook (3rd Edition). © 2000 Kluwer Scademic Publishers. pp. 770-771 and 840-845.*

Extended European Search Report dated Mar. 10, 2009.

* cited by examiner

*Primary Examiner* — Khanh Nguyen
*Assistant Examiner* — Carson Gross
(74) *Attorney, Agent, or Firm* — Carlson, Gaskey & Olds, P.C.

(57) ABSTRACT

System and methods involving pattern molds are provided. In this regard, a representative system includes a mold assembly unit having a movable fixture holder operative to engage a portion of a pattern mold and position the pattern mold for assembly.

17 Claims, 3 Drawing Sheets

SYSTEMS AND METHODS INVOLVING PATTERN MOLDS

BACKGROUND

1. Technical Field

The disclosure generally relates to casting.

2. Description of the Related Art

Manufacture of components, such as gas turbine engine components, can be accomplished using various techniques. Oftentimes, casting processes are used that involve formation of a component shape using a sacrificial material. This sacrificial material can be covered by another material in order to form a pattern mold of desired component shape. This involves removing the sacrificial material from the pattern mold so that material used to form the actual component can be placed in the location vacated by the sacrificial material for molding.

SUMMARY

System and methods involving pattern molds are provided. In this regard, an exemplary embodiment of a system comprises: a mold assembly unit having a movable fixture holder operative to engage a portion of a pattern mold and position the pattern mold for assembly.

An exemplary embodiment of a method comprises: interpreting a computer aided design (CAD) model of a mold assembly; providing a pattern mold having a component mold and a fixture; and positioning the fixture based, at least in part, upon information corresponding to the CAD model such that positioning of the fixture accommodates positioning of the pattern mold.

Another exemplary embodiment of a method comprises: providing a pattern mold having a component mold and a fixture; providing a movable fixture holder operative to engage the fixture of the pattern mold and position the pattern mold for assembly; and automatically positioning the fixture using the fixture holder based, at least in part, upon information corresponding to a computer aided design (CAD) model of a mold assembly.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

System and methods involving pattern molds are provided, several exemplary embodiments of which will be described in detail. In this regard, some embodiments involve the use of wax pattern molds to form gas turbine engine components. In some embodiments, a Computer Aided Design (CAD) model of a mold assembly is interpreted and information corresponding to the model is provided to a mold assembly unit that constructs a mold assembly. Notably, the mold assembly unit correlates position information from the model with patterns used to form the mold assembly, thereby reducing the potential for technician-injected placement errors that tend to occur during manual construction of such an assembly. Therefore, by using a mold assembly unit, calibrated repeatable assembly steps can be accommodated.

Figure 1:
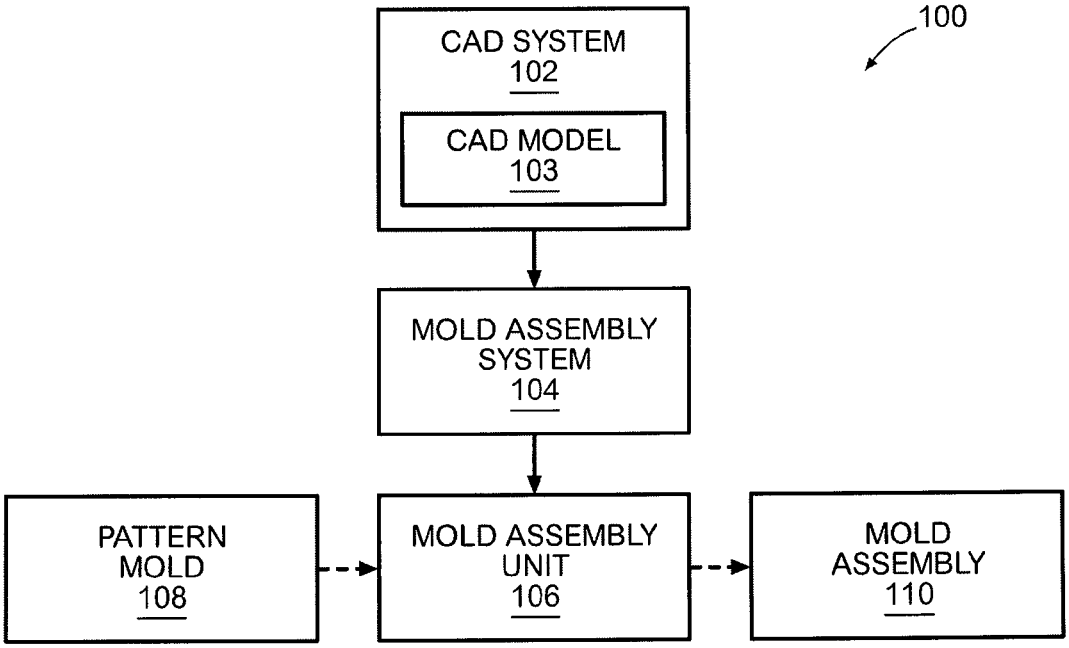
FIG. 1 is a schematic diagram depicting an embodiment of a system involving pattern molds.

Referring now in more detail to the drawings, FIG. 1 is a schematic diagram depicting an exemplary embodiment of a system involving pattern molds. As shown in FIG. 1, system 100 incorporates a CAD system 102 that is used to provide information corresponding to a CAD model 103 to a mold assembly system 104. The mold assembly system 104 interprets the CAD model 103 and provides instructions corresponding to positions of various features of the CAD model 103 to a mold assembly unit 106. Responsive to the instructions, the mold assembly unit 106 positions various patterns, e.g., pattern 108, to form a mold assembly, e.g., mold assembly 110. Once positioned, a technician can join the patterns 108 to the mold assembly 110, such as by wax soldering when the pattern 108 is formed of wax.

Figure 2:
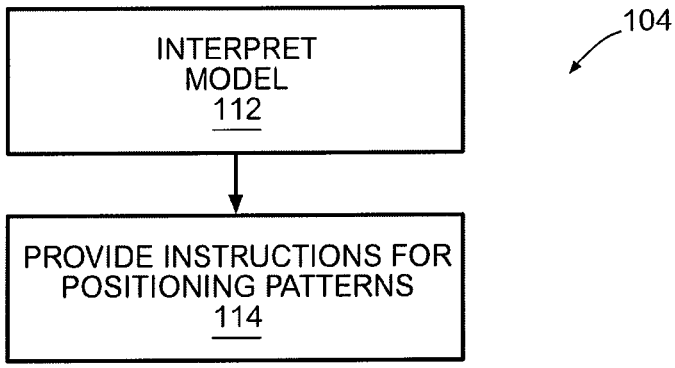
FIG. 2 is a flowchart depicting functionality of an embodiment of a mold assembly system.

As shown in FIG. 2, functionality of an embodiment of a mold assembly system (e.g., mold assembly system 104 of FIG. 1) involves interpreting a CAD model such as depicted in block 112. In particular, the mold assembly system interprets the model to determine pattern positioning. Then, as depicted in block 114, the mold assembly system provides instructions for positioning patterns 108 based, at least in part, on the interpretation of the CAD model 103. By way of example, the instructions can be provided to a mold assembly unit 106.

Figure 3:
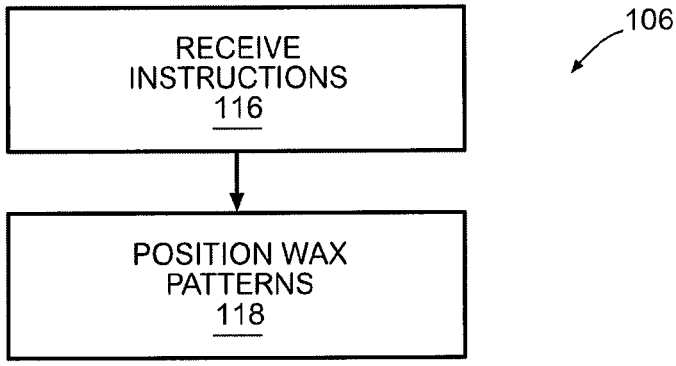
FIG. 3 is a flowchart depicting functionality of an embodiment of a mold assembly unit.

Functionality of an embodiment of a mold assembly unit (e.g., mold assembly unit 106 of FIG. 1) is depicted in the flowchart of FIG. 3. As shown in FIG. 3, the mold assembly unit receives instructions corresponding to the positioning of one or more mold patterns, as depicted in block 116. Then, as depicted in block 118, the patterns are positioned using the instructions.

Figure 4:
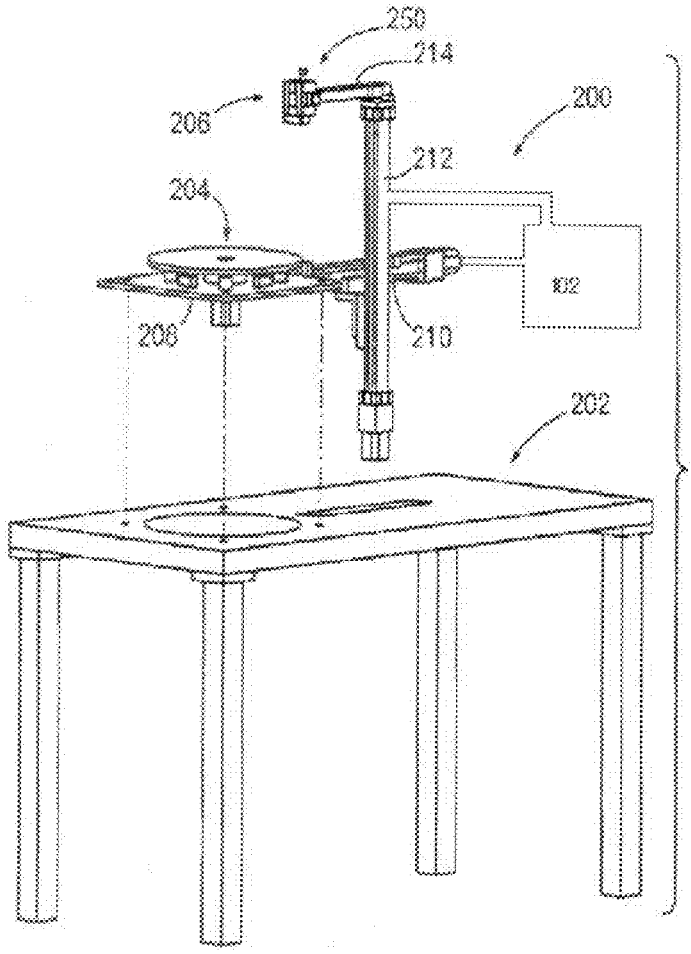
FIG. 4 is a partially exploded schematic diagram depicting an exemplary embodiment of a mold assembly unit.

An embodiment of a mold assembly unit is depicted in the partially exploded schematic diagram of FIG. 4. As shown in FIG. 4, mold assembly unit 200 includes a workbench 202, a turntable 204 and a controlled end-of-arm fixture holder 206. In the embodiment of FIG. 4, a base 208 of the turntable 204 is fixed in position relative to a horizontal rail 210. A vertical rail 212 is slidably attached to the horizontal rail such that the vertical rail can translate horizontally along the horizontal rail. The end-of-arm fixture holder 206 is attached to a horizontal arm 214 that extends outwardly from the vertical rail 212.

In operation, relative positioning of the end-of-arm fixture holder 206 and the turntable 204 can be adjusted by rotating the turntable 204, vertically positioning the horizontal arm 214 with respect to the vertical rail 212 and/or horizontally positioning the vertical rail 212 with respect to the horizontal rail 210. Notably, in this embodiment, the aforementioned positioning is accomplished by one or more stepper motors.

Figure 5:
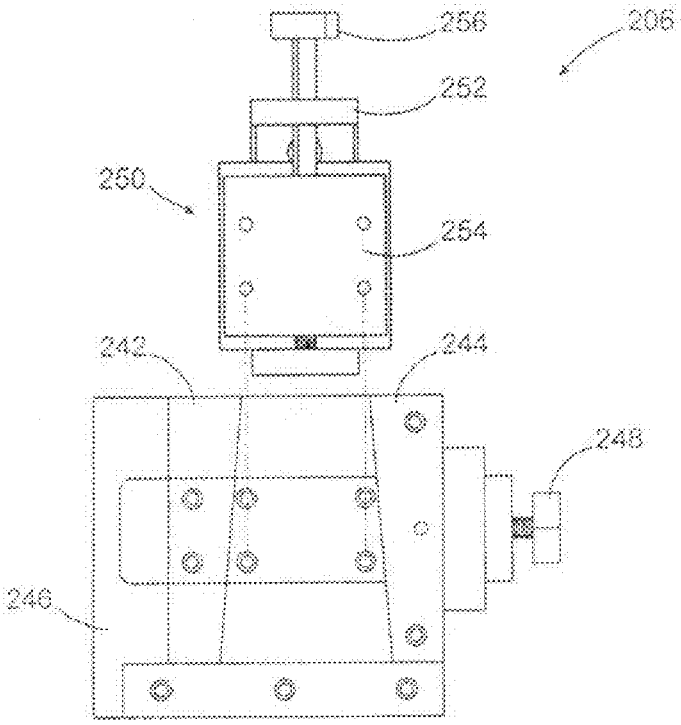
FIG. 5 is a partially exploded schematic diagram depicting an embodiment of an end-of-arm fixture holder.

As shown in greater detail in FIG. 5, the end-of-arm fixture holder 206 accommodates clamping of patterns (e.g., pattern 108 of FIG. 1) so that the patterns can be positioned for assembly. In the embodiment of FIG. 5, the end-of-arm fixture holder 206 incorporates two compound-angle vice blocks 242, 244, which move relative to a base 246. The vice blocks 242, 244 are adjustable between open and closed positions via a thumbscrew 248 that is mounted to the base 246.

A vertical adjustment (fine-tuning) mechanism 250 is mounted between the end-of-arm fixture holder 206 and the horizontal arm 214. In this embodiment, vertical adjustment mechanism 250 incorporates a base 252, which attaches to the horizontal arm 214, and an adjustable faceplate 254, which attaches to a back of the fixture holder 206. A thumbscrew 256, which is mounted to the base 252, accommodates vertical positioning of the fixture holder 206.

Figure 6:
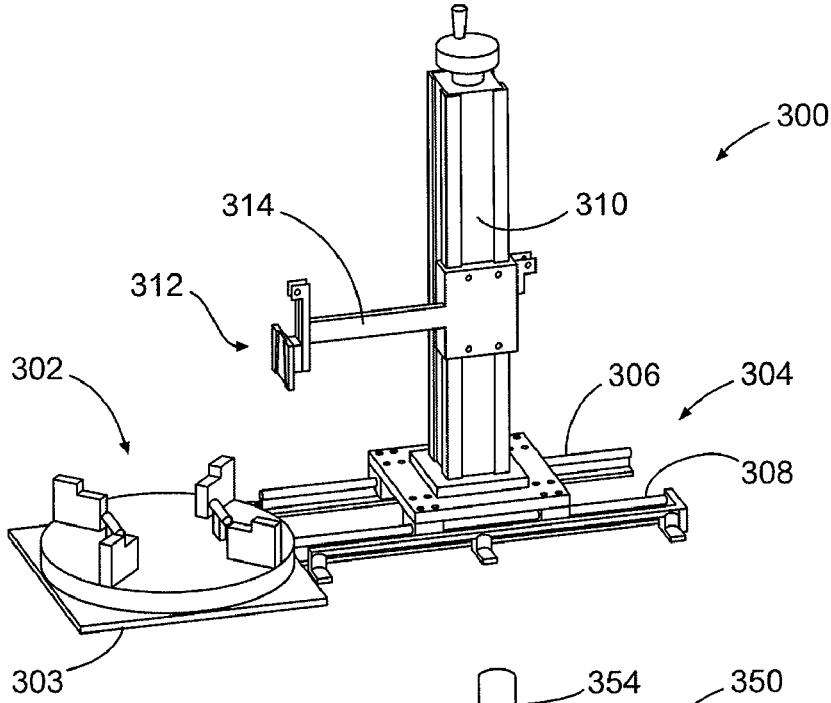
FIG. 6 is a schematic diagram depicting another exemplary embodiment of a mold assembly unit.

Another embodiment of a mold assembly unit is depicted schematically in FIG. 6. As shown in FIG. 6, mold assembly unit 300 incorporates a turntable 302, with a base 303 of the turntable 302 being fixed in position relative to a horizontal rail assembly 304. In this embodiment, the horizontal rail assembly 304 includes rails 306, 308 that are spaced from each other to provide a track along which a vertical rail 310 can translate. An end-of-arm fixture holder 312 (which, in this embodiment, is identical to fixture holder 206 of FIG. 4) is positioned by a horizontal arm 314. Horizontal arm 314 moves vertically along the vertical rail 310.

In contrast to the embodiment of FIG. 4, mold assembly unit 300 is manually controlled. In this regard, correlation between a CAD model and positioning of a pattern by mold assembly unit 300 is accommodated by a series of position indicators (not shown) located along each of the horizontal rail assembly 304, the vertical rail 310 and the fixture holder 312.

Figure 7:
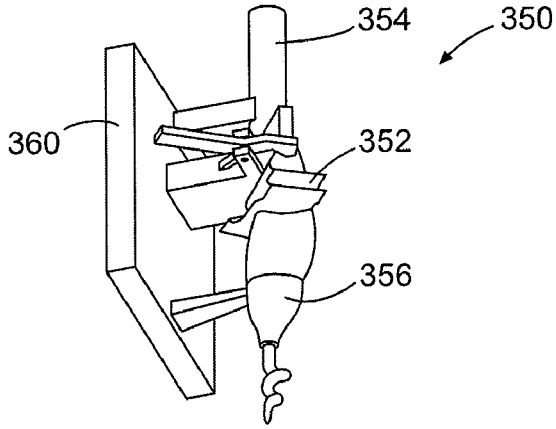
FIG. 7 is a schematic diagram depicting an exemplary embodiment of a pattern.

An embodiment of a mold pattern that can be positioned by a mold assembly unit is depicted schematically in FIG. 7. As shown in FIG. 7, mold pattern 350 incorporates a component mold 352, which is configured in this embodiment as a gas turbine engine blade. Feeding passages 354 are provided for enabling material to flow into the mold 352, and gating passages 356 are provided for enabling material to flow through the mold 352. Additionally, the pattern 350 incorporates an end-of-arm fixture 360. The end-of-arm fixture 360 is configured to enable positioning of the pattern 350. Specifically, the fixture 360 is designed such that, when the fixture 360 is seated within a corresponding fixture holder (e.g., fixture holder 206 of a mold assembly unit 200), proper orientation of the pattern 350 is established. Thereafter, horizontal and vertical positioning of the end-of-arm fixture holder 360 by the mold assembly unit 200 in combination with positioning of a mold cage 370 using the turntable can properly position the mold pattern 350 relative to the mold cage 370. In this regard, positioning of a mold pattern 350 relative to a representative mold cage 370 is depicted schematically in FIG. 8.

Figure 8:
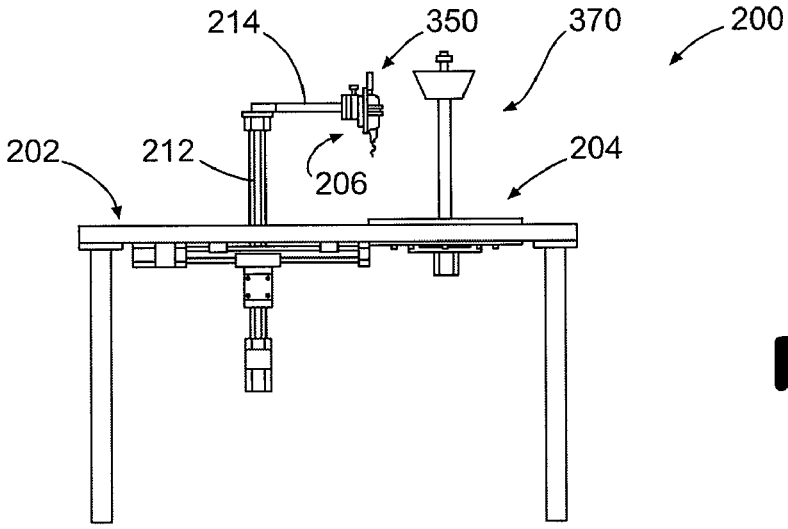
FIG. 8 is a schematic diagram depicting the assembly unit of FIG. 4 positioning the pattern mold of FIG. 7 to form a mold assembly.

As shown in FIG. 8, mold pattern 350 is held in position relative to mold cage 370 by mold assembly unit 200. Specifically, the end-of-arm fixture 360 is held by end-of-arm fixture holder 206.

Various functionality, such as that described above in the flowcharts, can be implemented in hardware and/or software. In this regard, a computing device can be used to implement various functionality, such as that depicted in FIGS. 2 and 3.

In terms of hardware architecture, such a computing device can include a processor, memory, and one or more input and/or output (I/O) device interface(s) that are communicatively coupled via a local interface. The local interface can include, for example but not limited to, one or more buses and/or other wired or wireless connections. The local interface may have additional elements, which are omitted for simplicity, such as controllers, buffers (caches), drivers, repeaters, and receivers to enable communications. Further, the local interface may include address, control, and/or data connections to enable appropriate communications among the aforementioned components.

The processor may be a hardware device for executing software, particularly software stored in memory. The processor can be a custom made or commercially available processor, a central processing unit (CPU), an auxiliary processor among several processors associated with the computing device, a semiconductor based microprocessor (in the form of a microchip or chip set) or generally any device for executing software instructions.

The memory can include any one or combination of volatile memory elements (e.g., random access memory (RAM, such as DRAM, SRAM, SDRAM, VRAM, etc.)) and/or nonvolatile memory elements (e.g., ROM, hard drive, tape, CD-ROM, etc.). Moreover, the memory may incorporate electronic, magnetic, optical, and/or other types of storage media. Note that the memory can also have a distributed architecture, where various components are situated remotely from one another, but can be accessed by the processor.

The software in the memory may include one or more separate programs, each of which includes an ordered listing of executable instructions for implementing logical functions. A system component embodied as software may also be construed as a source program, executable program (object code), script, or any other entity comprising a set of instructions to be performed. When constructed as a source program, the program is translated via a compiler, assembler, interpreter, or the like, which may or may not be included within the memory.

The Input/Output devices that may be coupled to system I/O Interface(s) may include input devices, for example but not limited to, a keyboard, mouse, scanner, microphone, camera, proximity device, etc. Further, the Input/Output devices may also include output devices, for example but not limited to, a printer, display, etc. Finally, the Input/Output devices may further include devices that communicate both as inputs and outputs, for instance but not limited to, a modulator/demodulator (modem; for accessing another device, system, or network), a radio frequency (RF) or other transceiver, a telephonic interface, a bridge, a router, etc.

When the computing device is in operation, the processor can be configured to execute software stored within the memory, to communicate data to and from the memory, and to generally control operations of the computing device pursuant to the software. Software in memory, in whole or in part, is read by the processor, perhaps buffered within the processor, and then executed.

One should note that the flowcharts included herein show the architecture, functionality, and operation of a possible implementation of software. In this regard, each block can be interpreted to represent a module, segment, or portion of code, which comprises one or more executable instructions for implementing the specified logical function(s). It should also be noted that in some alternative implementations, the functions noted in the blocks may occur out of the order and/or not at all. For example, two blocks shown in succession may in fact be executed substantially concurrently or the blocks may sometimes be executed in the reverse order, depending upon the functionality involved.

One should note that any of the functionality described herein can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" contains, stores, communicates, propagates and/or transports the program for use by or in connection with the instruction execution system, apparatus, or device. The computer readable medium can be, for example but not limited to, an electronic, magnetic, optical, electromagnetic, infrared, or semiconductor system, apparatus, or device. More specific examples (a nonexhaustive list) of a computer-readable medium include a portable computer diskette (magnetic), a random access memory (RAM) (electronic), a read-only memory (ROM) (electronic), an erasable programmable read-only memory (EPROM or Flash memory) (electronic), and a portable compact disc read-only memory (CDROM) (optical).

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A system involving pattern molds comprising:

a mold assembly unit having a fixture holder moveable relative to an attached arm and operative to engage a portion of a pattern mold and position the pattern mold for assembly, wherein the mold assembly unit has a turntable operative to rotate relative to the fixture holder and a rail assembly operative to position the fixture holder relative to the turntable, a computer aided design (CAD) system, wherein the mold assembly unit is operative to receive information corresponding to the positioning of the pattern mold from the CAD system, the mold assembly unit further operative to interpret a computer aided design (CAD) model of a mold assembly in which the pattern mold is to become a constituent part such that the information corresponding to the positioning of the pattern mold is generated and communicated to mold assembly unit, the CAD system operative to generate a CAD model of the mold assembly.

2. The system of claim 1, wherein the mold assembly unit automatically positions the pattern mold based, at least in part, on the information received.

3. The system of claim 2, wherein the mold assembly unit comprises a stepper motor operative to facilitate positioning of the pattern mold.

4. The system of claim 1, further comprising a first pattern mold having a component mold and a fixture, the fixture being oriented with respect to the component mold such that, when the fixture is received by the fixture holder, the mold assembly unit is able to accommodate position of the pattern mold.

5. The system of claim 4, wherein the pattern mold is formed of wax.

6. The system of claim 4, wherein the component mold is configured to form a gas turbine engine component.

7. A mold assembly arrangement comprising:

a mold assembly unit including:

a moveable arm and a plurality of moveable fixture holders, wherein at least one of the plurality of fixture holders is attached to and independently moveable relative to the moveable arm, a base, the moveable arm oriented relative to said base;

a plurality of patterns; and a plurality of fixtures, wherein each fixture is removably attached to at least one of the plurality of patterns, each fixture removably attaching to one of the plurality of fixture holders such that each of the plurality of patterns are oriented relative to the base for desired positional assembly on the base, and wherein the mold assembly unit is configured to position each of the plurality of patterns on the base.

8. The mold assembly arrangement of claim 7, wherein the moveable arm moves along a first axis and a second axis.

9. The mold assembly arrangement of claim 8, wherein a computer aided design (CAD) system determines the positioning of the moveable arm relative to the first axis and the second axis.

10. The mold assembly arrangement of claim 9, wherein each of the plurality of patterns is positioned on the base at a position determined by the CAD system positioning of the moveable arm at a first position on the first axis and a second position on the second axis.

11. The mold assembly arrangement of claim 7, wherein the base is a rotatable turntable.

12. The mold assembly arrangement of claim 7, wherein each of the plurality of fixtures are formed non-uniformly, specific to each corresponding pattern.

13. The mold assembly arrangement of claim 7, wherein the end of arm fixture holder is independently moveable by vertical adjustment mechanism between the end of arm fixture holder and the moveable arm.

14. The mold assembly arrangement of claim 13, wherein the vertical adjustment mechanism includes a first side attached to the moveable arm and a second side attached to the end of arm fixture holder, a thumbscrew positioned on the first side to provide vertical movement.

15. The assembly of claim 7, wherein the mold assembly unit comprises a stepper motor operative to facilitate positioning of the pattern mold.

16. The assembly of claim 7, wherein the orientation of each of the plurality of patterns it at least partially determined by the corresponding fixture.

17. The assembly of claim 7, wherein identical patterns among the plurality of patterns having the same orientation use identical fixtures among the plurality of fixtures.

* * * * *